United States Patent [19]

Luterek

[11] Patent Number: 4,708,095

[45] Date of Patent: Nov. 24, 1987

[54] COMBINED ENGINE COOLING AND LUBE SYSTEM

[75] Inventor: Garry M. Luterek, Waterloo, Iowa

[73] Assignee: Deere & Company, Moline, Ill.

[21] Appl. No.: 874,903

[22] Filed: Jun. 16, 1986

[51] Int. Cl.[4] ..... F01P 3/00

[52] U.S. Cl. ..... 123/41.42; 123/41.31; 123/41.85; 123/563

[58] Field of Search ..... 123/41.42, 41.33, 41.31, 123/41.85, 563, 196 AB

[56] References Cited

U.S. PATENT DOCUMENTS

| | | | |
|---|---|---|---|
| 2,078,499 | 4/1937 | Ljungstrom | 123/41.42 |
| 2,085,810 | 7/1937 | Ljungstrom | 123/41.42 |
| 2,580,572 | 1/1952 | McMillan | 123/196 AB |
| 2,696,203 | 12/1954 | Nallinger | 123/196 AB |
| 2,725,044 | 11/1955 | Doyle | 123/41.42 |
| 2,856,543 | 10/1958 | Dixon et al. | 123/196 AB |
| 3,127,879 | 4/1964 | Giacosa et al. | 123/41.42 |
| 3,162,998 | 12/1964 | Williams | 123/41.33 |
| 3,456,759 | 7/1969 | Henry-Biabaud | 184/6 |
| 4,136,824 | 1/1979 | Kallenbach | 184/104 |
| 4,348,991 | 9/1982 | Stang et al. | 123/41.42 |
| 4,352,455 | 10/1982 | Moser et al. | 123/196 AB |
| 4,364,339 | 12/1982 | Fricker et al. | 123/41.42 |
| 4,386,735 | 6/1983 | Tholen et al. | 126/247 |
| 4,397,269 | 8/1983 | Hatz | 123/41.33 |
| 4,413,597 | 11/1983 | Stang et al. | 123/41.42 |
| 4,432,493 | 2/1984 | Moser et al. | 126/247 |
| 4,434,934 | 3/1984 | Moser et al. | 126/247 |
| 4,449,487 | 5/1984 | Kruger et al. | 123/196 AB |
| 4,487,364 | 12/1984 | Okulicz et al. | 123/196 AB |
| 4,541,368 | 9/1985 | Castarede | 123/41.33 |
| 4,592,323 | 6/1986 | Vest | 123/196 AB |

*Primary Examiner*—E. Rollins Cross

[57] ABSTRACT

An internal combustion engine includes separate engine cooling and engine lubrication circuits, both of which receive engine oil pumped from the oil sump. The cooling circuit flows oil around hot engine parts and then to a cab heater and to a heat exchanger or a bypass line to sump. A valve controls oil flow to the heat exchanger and to the bypass line as a function of oil temperature in a part of the lube circuit in the engine block. The heat exchanger has a pair of outlets which discharge oil at different temperatures and at different flow rates. Less oil flows from the cooler outlet and this lesser flow is communicated to sump via a charge air cooler. The hotter outlet communicates the larger oil flow directly to sump.

5 Claims, 1 Drawing Figure

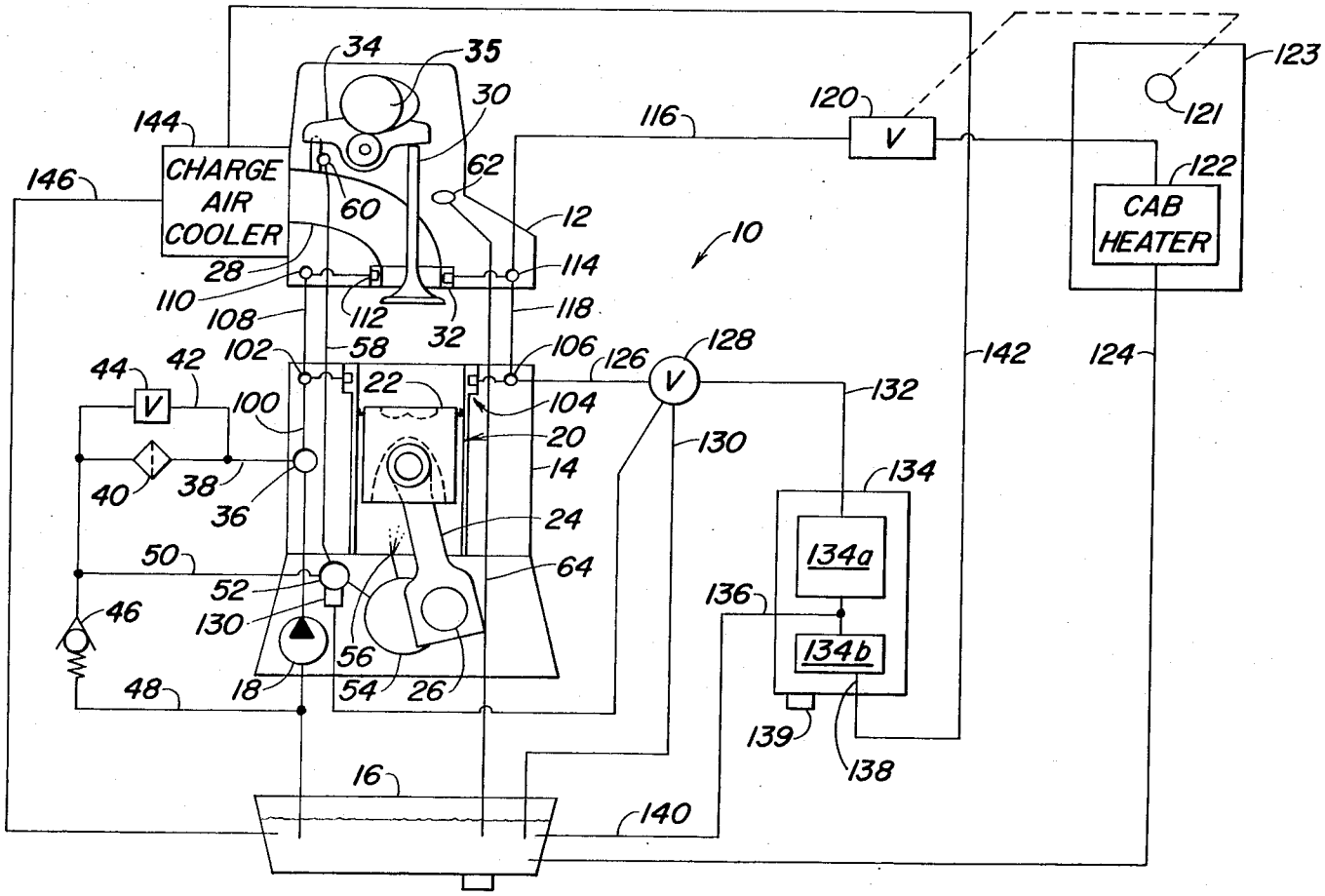
CAB HEATER
CHARGE AIR COOLER
V
V
V
134a
134b
10
12
14
16
18
20
22
24
26
28
30
32
34
35
36
38
40
42
44
46
48
50
52
54
56
58
60
62
64
100
102
104
106
108
110
112
114
116
118
120
121
122
123
124
126
128
130
132
134
136
138
139
140
142
144
146

COMBINED ENGINE COOLING AND LUBE SYSTEM

BACKGROUND OF THE INVENTION

The present invention relates to a combined cooling and lubrication system for an internal combustion engine, in particular a system wherein engine oil performs both the lubrication and cooling function.

It is known to use engine oil for cooling as well as lubrication, as shown in U.S. Pat. No. 2,078,449 issued 27 Apr. 1937 and in U.S. Pat. No. 4,413,597 issued 8 Nov. 1983. It is also known to use engine oil for vehicle cab heating as shown in U.S. Pat. No. 4,449,487 issued 22 May 1984 to Kruger et al. However, the Kruger system requires two separate oil pumps, one for cooling oil and another for lube oil. It is also known to use cooled lube oil to cool charge air to be introduced into the engine, as shown in U.S. Pat. No. 3,102,998 issued Dec. 29, 1964 to Williams. However, in the Williams system all oil which flows through the intercooler must also flow completely through the oil cooler. This requires that the oil cooler have a capacity sufficient to cool all the oil down to the temperature required by the intercooler, which may be a lower temperature than the temperature required for lubrication. Williams does not show using engine oil for both engine cooling and lubricating. It would be desirable to provide a complete engine oil lube and cooling system which provides for both cab heating and for charge air cooling.

SUMMARY OF THE INVENTION

An object of the present invention is to provide a system wherein the engine oil performs engine cooling and engine lube functions.

Another object of this invention is to provide such a system which also includes cab heating.

A further object is to provide such a system which also provides efficient and effective charge air cooling without the necessity of cooling all the oil down to the temperature required by the charge air cooler.

These and other objects are achieved by the present invention wherein an engine oil is pumped from an engine sump to separate lubrication and engine cooling circuits. The lube circuit lubricates the main bearings, camshaft parts of the engine subject to wear. The cooling circuit includes cooling ducts in the engine head and block. Hot oil from the engine flows via an operator controlled valve to a cab heater and then back to sump. Hot oil from the engine also flows via a temperature controlled valve to sump via a bypass line, or to a heat exchanger. The temperature controlled valve operates in response to lube oil temperature sensed in a lube oil gallery in the engine block. The heat exchanger has a higher temperature outlet communicated to sump and a lower temperature outlet communicated to a charge air cooler and then to sump.

BRIEF DESCRIPTION OF THE DRAWINGS

The FIG. is a schematic diagram of an engine cooling and lubricating system constructed according to the present invention.

DETAILED DESCRIPTION

An internal combustion engine 10 includes a head 12, a block 14, an oil sump 16 and an oil pump 18. The block 14 includes a plurality of cylinders, one of which is shown in the Figure. A piston 22 reciprocates in the cylinder 20. Connecting rods 24 connect the piston 22 with a crankshaft 26. The head 12 includes inlet ports 28, exhaust ports (not shown), valves 30, valve seats 32 and rocker arms 34 driven by an overhead camshaft 35.

The pump 18 draws oil from the sump 16 and pumps it to a main gallery 36. Oil from the main gallery 36 flows eventually back to sump 16 via separate lube and cooling circuits which are connected in parallel relationship to each other.

Lube oil flows from gallery 36 via line 38 to filter 40. A bypass line 42 routes oil around filter 40 when bypass valve 44 opens in response to clogging of filter 40. Oil flows from filter 40 to sump via a pressure regulating valve 46 and line 48. Oil can also flow from filter 40 via line 50 to lube gallery 52 which is formed in the engine block 14.

The lube gallery 52 supplies lube oil to conventional engine lubricating systems such as a main bearing lube passage 54 and oil sprayers 56. Lube oil also flows from lube gallery 52 via line 58 to head lube gallery 60 which supplies lube oil to the bearings for rocker arm 34 and the overhead camshaft 35. The lube oil in the head is collected at gallery 62 and then communicated back to sump 16 by drain line 64.

The engine cooling circuit includes line 100 which conducts oil from main gallery 36 to gallery 102 near the upper region of the cylinder 20. Cooling oil flows from gallery 102 to annular coolant passages 104 which cool the top portion of the cylinder 20, then to gallery 106.

Line 108 conducts cooling oil from gallery 102 to gallery 110 in the head 12. From gallery 110 oil flows through annular cooling passages 112 formed around the exhaust port valve seat 32, then to head gallery 114. Oil flows from gallery 114 via either line 116 or line 118. Line 116 communicates heated oil from the engine 10 via control valve 120 to a cab heater 122, and then back to sump 16 via line 124. Preferably, the control 121 for valve 120 is located in the vehicle cab 123 so that the amount of hot oil communicated to the cab heater can be adjusted by the vehicle operator. Line 118 conducts fluid from head gallery 114 to block gallery 106. Line 126 conducts oil from gallery 106 to a temperature controlled thermostatic valve 128. Valve 128 preferably is controlled in response to the lube oil temperature in main lube gallery 52 which is sensed by a temperature sensor 130 located in block 14 so as to be exposed to lube oil in gallery 52. Valve 128 conducts hot oil from line 126 either to sump 16 via bypass line 130 or to a radiator or heat exchanger 134 via line 132. The heat exchanger 134 includes series connected first and second sections **134*a* and 134*b*. The heat exchanger has a first outlet 136, a second outlet 138 and a drain 139. The outlet 136 draws oil which has flowed through first section 134*a* only. Outlet 138 draws oil which has flowed through both sections 134*a* and 134*b*. Thus, oil at outlet 136 will be hotter than the oil at outlet 138. For example, if the oil in line 132 is at 140° C., then oil at outlet 136 could be at 110° C. and oil at outlet 138 could be at 60° C. Preferably, the heat exchanger 134 is constructed to provide more volume of flow at hotter outlet 136 than the volume of flow at cooler outlet 138. Thus, the additional heat exchanger capacity required to cool the oil to the lower temperature at outlet 138 need not handle all of the oil flowing through heat exchanger 134, since the flow out of cooler outlet need only be about half the flow from hotter outlet 136**. Line 140 conducts cooled oil from the heat exchanger outlet 136 to the sump 16. Line 142 conducts oil from outlet 138 to a charge air cooler 144 and then to sump 16 via line 146. The foregoing description applies in the case of an intercooled engine. However, in the case of a naturally asperated engine which does not include a charge air cooler, the second outlet 138 and the lines 142 and 146 are not needed.

If this system were used with a turbocharged engine (not shown) then an additional lube supply line (not shown) could be used to conduct lube oil from filter 40 to the turbo (not shown) and then back to the sump 16.

I claim:

1. In a vehicle having an internal combustion engine, an engine cooling and lube system comprising: an engine oil sump;

an engine oil pump;

a flow divider having an inlet communicated with an outlet of the pump, a first outlet and a second outlet;

an engine cooling circuit connected between the first outlet and the sump for cooling heated parts of the engine;

an engine lube circuit connected between the second outlet and the sump for lubricating parts of the engine subject to wear, the lube circuit being connected in parallel with the engine cooling circuit; and a vehicle cab heater comprising a fluid-to-air heat exchanger connected in the engine cooling circuit between the engine and the sump.

2. The cooling and lube system of claim 1, wherein the cooling circuit comprises:

a heat exchanger for cooling the engine oil and having an inlet for receiving heated oil from the engine, a first outlet for communicating cooled oil at a first temperature to the sump and a second outlet for removing cooled oil at a second temperature from the heat exchanger, the second temperature being lower than the first temperature; and a charge air cooler for transferring heat from engine induction air to the engine oil, the charge air cooler having an oil inlet communicated with the second outlet of the heat exchanger and having an oil outlet communicated with the sump.

3. The cooling and lube system of claim 2 further comprising:

a temperature controlled valve having an inlet receiving heated cooling oil from the engine, a first outlet communicated with the heat exchanger inlet, and having a second outlet;

a bypass line communicating the second control valve outlet with the sump;

a temperature sensor for sensing the temperature of oil in the engine lube circuit, the temperature controlled valve controlling oil flow through the bypass line and the heat exchanger as a function of the temperature sensed by the temperature sensor.

4. The cooling and lube system of claim 1, wherein the flow divider comprises:

a bore extending in a block of the engine;

an inlet passage communicated with the pump outlet;

a first outlet passage in the block and communicating the bore with the cooling circuit; and a second outlet passage communicating the bore with the lube circuit.

5. An engine cooling and lube system, comprising:

an engine oil sump;

an engine oil pump;

an engine lube circuit connected between the pump and the sump for directing oil to engine parts subject to wear;

a temperature sensor for sensing the temperature of oil in the lube circuit;

an engine cooling circuit connected between the pump and the sump in parallel relationship to the lube circuit, the cooling circuit including a heat exchanger for cooling heated oil received from the engine, a bypass line communicating with the sump and a valve coupled to the temperature sensor to control oil communication from the engine to the heat exchanger and to the bypass line as a function of the temperature sensed by the temperature sensor.

* * * * *

Disclaimer 4,708,095.—*Garry M. Luterek*, Waterloo, Iowa. COMBINED ENGINE COOLING AND LUBE SYSTEM. Patent dated Nov. 24, 1987. Disclaimer filed Feb. 16, 1989, by the assignee, *Deere & Co.*

Hereby enters this disclaimer to claim 1 of said patent.

[*Official Gazette April 18, 1989.*]